US006139297A

United States Patent [19]

Becher

[11] Patent Number: 6,139,297

[45] Date of Patent: Oct. 31, 2000

[54] DOUBLE WORM SYSTEM

[75] Inventor: Ulrich Becher, Porrentruy, Switzerland

[73] Assignee: Ateliers Busch S.A., Chevenez, Switzerland

[21] Appl. No.: 09/077,963

[22] PCT Filed: Jul. 8, 1996

[86] PCT No.: PCT/CH96/00250

§ 371 Date: Feb. 8, 1999

§ 102(e) Date: Feb. 8, 1999

[87] PCT Pub. No.: WO97/21925

PCT Pub. Date: Jun. 19, 1997

[30] Foreign Application Priority Data

Dec. 11, 1995 [CH] Switzerland ..... 3487/95

[51] Int. Cl.[7] ..... F01C 21/00

[52] U.S. Cl. ..... 418/151; 418/210.1

[58] Field of Search ..... 418/151, 201.1

[56] References Cited

U.S. PATENT DOCUMENTS

| | | | |
|---|---|---|---|
| 2,714,314 | 8/1955 | Ulander . | |
| 3,918,838 | 11/1975 | Moody, Jr. et al. | 418/201.1 X |
| 4,490,102 | 12/1984 | Carre et al. | 418/201.1 |
| 5,167,496 | 12/1992 | Jacobsson et al. | 418/201.1 X |
| 5,269,667 | 12/1993 | Mauney | 418/201.1 |
| 5,273,412 | 12/1993 | Zwaans | 418/201.1 X |

FOREIGN PATENT DOCUMENTS 62-291486 12/1987 Japan .

*Primary Examiner*—Hoang Nguyen
*Attorney, Agent, or Firm*—Clifford W. Browning; Woodard, Emhardt, Naughton, Moriarity & McNett

[57] ABSTRACT

In prior art designs, single-flight cast double worms with angles of contact >720° with large balance hollows at both ends and worm lengths of whole multiples of the pitch operate in the medium rotation speed ranges (~3000 $min^{-1}$) without imbalance. The desired use of special uncastable materials and the manufacturing complexity and the necessary dimensional stability even for extreme profile geometries pose additional problems in balancing which are solved by the present invention. Here, it is possible, by varying the angle of contact of the worm and any balance hollows and/or by altering the contour of the worms in the medium engagement region, to reduce the size of the balance hollows, sometimes to "zero", and with the possible use of additional masses. Besides the advantage of simple raw component manufacture, worms balanced in this way also permit the use of special materials and extreme worm geometries for fitting in pumps used in the chemical, medical and food sectors.

20 Claims, 3 Drawing Sheets

DOUBLE WORM SYSTEM

The invention relates to measures for the balancing of a twin screw system in axis-parallel arrangement with outer-axis engagement in counter-rotation, and with angles of contact of at least 720° in single-flight design. The distance between centre of gravity and centre, end face, and angle of contact determine in this context the values of the static and dynamic imbalances which occur with screws with single-flight profiles.

In the disclosure text Sho 62(1987)-291486 from the company Taiko, Japan, a method of screw balancing is described: First, static balance is achieved by determining the length of the screw in integer multiples of the pitch. By means of cut-outs in the screw on both sides, on the face side, which are hollow or filled with light material, dynamic balance is achieved.

This method of balancing cannot be implemented if special materials are demanded, which cannot be cast. With unusual profile geometries, too, this method has its limits, since on the one hand the wall thicknesses of the screws cannot, for reasons of stability, be reduced at will: on the other band, an excessively great extension in axial direction of the balancing hollows would incur big manufacturing problems because of the helical shape.

The invention is based on the objective of defining measures for the balancing of single-flight screws, the geometry of which is unusual or the use of which requires special materials, without incurring major investment in the manufacture and without prejudicing form stability.

Figure 1:
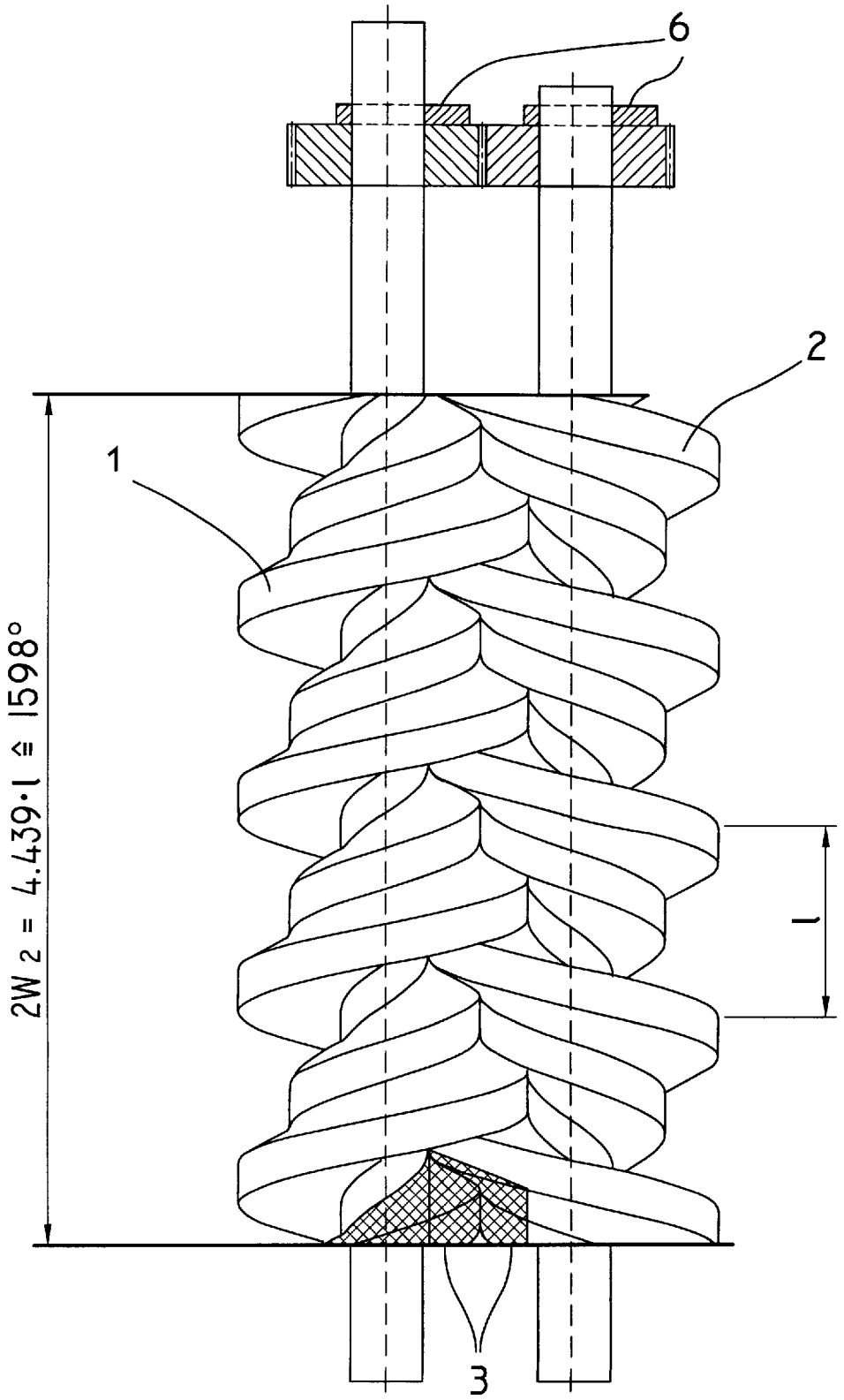

This objective is achieved according to the invention by means of a twin screw system 1, 2 (FIG. 1) in axis-parallel arrangement with outside axis engagement with counter-running movement, and angles of contact of at least 720° in single-flight design, in such a way that the lengths of the screws are not fixed at integer multiples of the pitch, and that the outer contours of the screw are changed in the medium intake area in order to achieve balancing 3 (FIG. 1).

Possible embodiments are provided by the application of additional masses 6 (FIG. 1) in the outer area, in particular at the pilot gear, as well as by face-side balancing hollows 4 (FIG. 2), the axial extension of which is varied for the purpose of optimisation.

The advantages achieved with the invention are:

1. Easier manufacture and greater form stability in the case of the application of face-side balancing hollows, achieved by the optimum dimensioning of screw angles of contact, winding angles of balancing hollow, and balancing hollow cross-section.
2. The possibility of using special materials, which cannot be cast.
3. Reduced screw surface areas in the outlet area, which has the effect of reducing temperature.

On the basis of the embodiments shown in the figures, the invention is now explained in greater detail:

The figures show:

FIG. 1: A twin screw system for a screw pump in single-flight design according to the invention, with angles of contact of 1598° and balancing cut-outs at the screw outer contours in the medium intake area.

Figure 2:
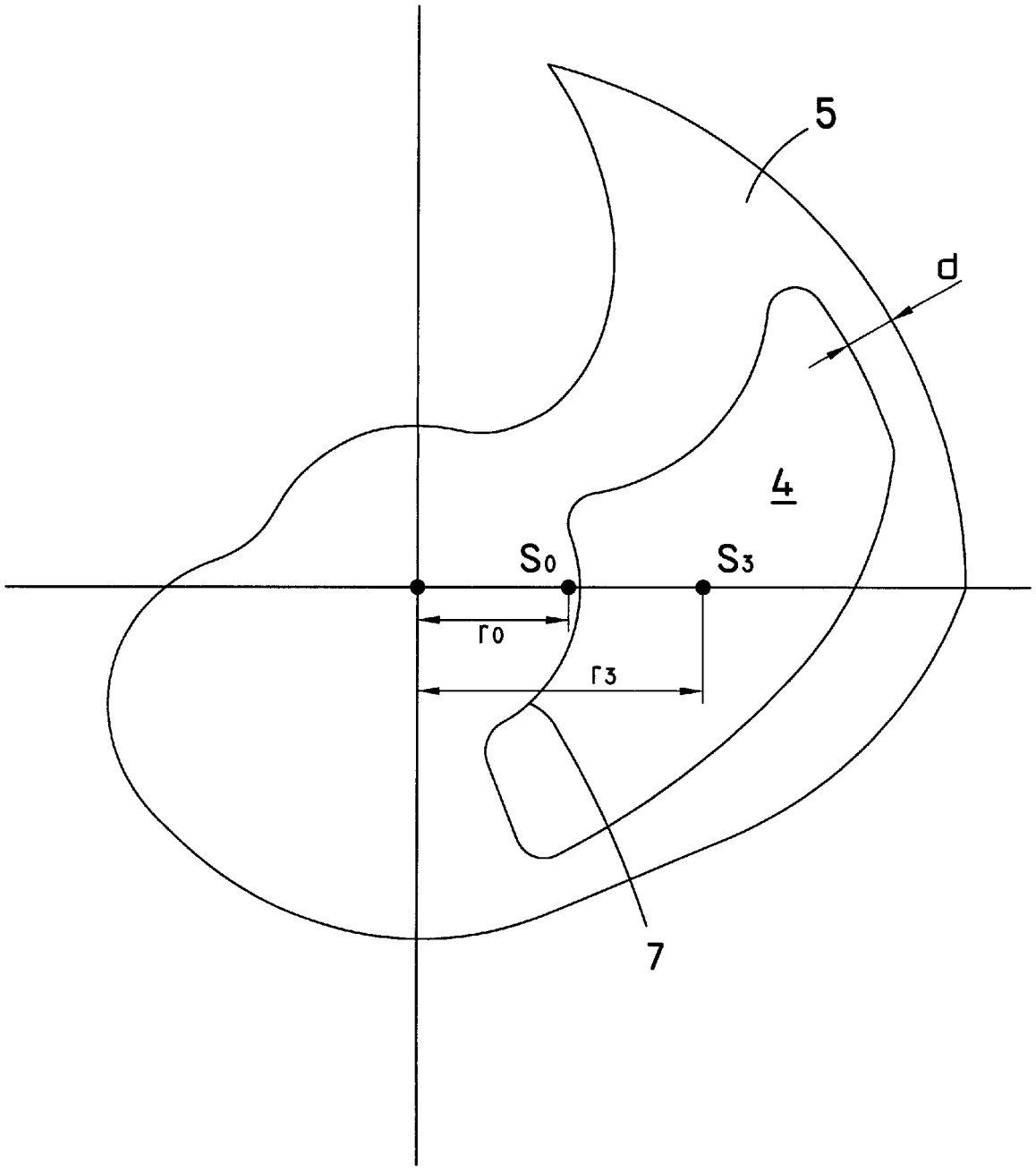

FIG. 2: An embodiment of a twin screw system from FIG. 1 with balancing hollows in a frontal view.

Figure 3:
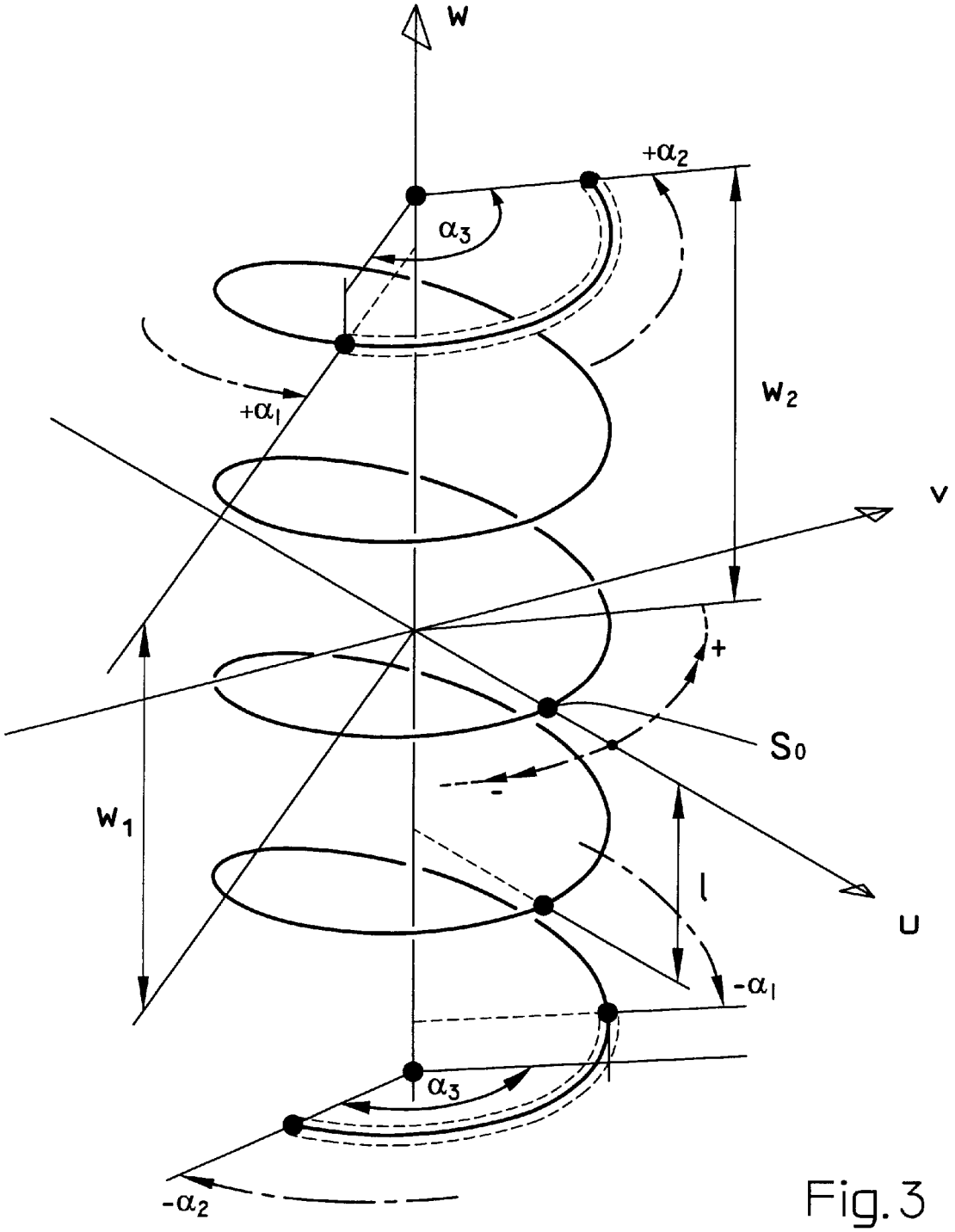

FIG. 3: The representation of the helical profile centre-of-gravity location curve of a screw profile from FIG. 2.

In one embodiment, the twin screws 1, 2 (FIG. 1) feature lengths of 4.439 times the pitch, which corresponds to an angle of contact of 1598° (FIG. 3). The end profile S (FIG. 2) and the pitch 1 (FIG. 1) determine, together with the wall thickness d (FIG. 2), the greatest part of the contour of the axially-located balancing hollows 4 (FIG. 2); the core circle 7 (FIG. 2) delimits this towards the centre. With common angle positions of the centres of gravity of the full profile and balancing surfaces $S_0$, $S_3$ (FIG. 2), the straight termination is mandatorily derived in the balance surface.

By calculation, the problem is dealt with as follows:

In a rectangular co-ordinate system with a screw axis as w-axis and u-axis and v-axis in the plane of the middle screw face sections, the centre of gravity $S_0$ (FIG. 3) is positioned on the u-axis. The extension of the screw in the w-direction extends symmetrically from $-W_2 \ldots +W_2$ or in angle definition from $-\alpha_2 \ldots +\alpha_2$, with a relationship of $\alpha_2=(2\pi/1)\cdot W_2$(II), where $2\alpha_2$ is the angle of contact of the screw and $\pi$= circle coefficient=3.1415 . . .

The areas of the end-side balancing hollows are at $-W_2 \ldots -W_1$ and $+W_1 \ldots +W_2$, which corresponds to angle positions of $-\alpha_2 \ldots -\alpha_1$ and $+\alpha_1 \ldots +\alpha_2$ with $\alpha_1=(2\pi/1)\cdot W_1$ (I).

The winding angles of a balancing hollow in each case are therefore $\alpha_3=\alpha_2-\alpha_1$ (III).

With symmetrical balancing hollows with a constant value $g_3$ of the product from the area $f_3$ and centre of gravity distance from the centre $r_3$ (FIG. 2) ($g_3=f_3\cdot r_3$=constant (IV)), the requirements for static and dynamic balancing lead to the formulae $\alpha_2\cdot\sin\alpha_1\ \cos\alpha_2=\alpha_1\cdot\cos\alpha_1\ \sin\alpha_2$ (V) and $g_3=g_0\ (\sin\alpha_2-\alpha_2\cos\alpha_2)/(\sin\alpha_2-\sin\alpha_1-\alpha_2\cos\alpha_2+\alpha_1\cos\alpha_1)$ (VI), where $g_0$ signifies the product from the full profile surface $f_0$ and the centre of gravity distance from the centre $r_0$ (FIG. 2), $\alpha_2$ and $\alpha_1$ are to be located in the arc mass, and $g_3$ corresponds to the definition given above.

Equation (V) provides for every desired screw angle of contact $2\alpha_2$ (with $\alpha_2>2\pi$) at least one solution for $\alpha_1$; from $\alpha_1$ and $\alpha_2$ are derived the dimensions for the balancing hollows; from (III) the winding angle; and from (VI) the reference cross-section $g_3$.

For manufacturing reasons, the winding angle $\alpha_3$ of the balancing hollow should be as small as possible; accordingly, with several solutions for al, the greatest possible value of $\alpha_1$ with $\alpha_1<\alpha_2$ is used. Precise examinations show that the most unfavourable relationships occur with screw lengths of integer multiples of the pitch, at $2W_2$=2L, 3L, 4L, 5L . . . K·L, corresponding to the embodiment according to the disclosure text referred to above. The winding angle of balancing hollow in that case amounts to $\alpha_3=\pi$, the dynamic characteristic $g_3$ attains a maximum, which requires a maximum balancing hollow: $g_3$, Max=$g_0\cdot k/(2k-1)$ i.e. for a screw length of four times the pitch, in that case $g_3=g_0\cdot{}^4/_7$.

For the embodiment of the invention described here, screws are selected with angles of contact of $2\alpha_2=5\pi$, $7\pi$, $9\pi$. . . , corresponding to screw lengths of $2W_2=5\cdot½$, $7\cdot½$, $9\cdot½$.

The winding angles of balancing hollow are then likewise $\alpha_3=\pi$, but the dynamic characteristic $g_3$ in this case attains a minimum, which signifies a minimal balancing hollow: $g_3$, Min=$g_0/2$.

Reinforcing ribs at the end of the balancing hollows lead to asymmetric relationships, which in part are compensated by the correction of the winding angles $2\alpha_2$, $\alpha_3$.

As a further measure for balancing, the screws 1, 2 are altered at the passive outer contour parts on the suction side. The passive area 3 (FIG. 1) extends with both screws over all the parts which are not required either for the formation of the first suction side operating cell or for maintaining stability. This outer balancing can be used as an alternative to or in combination with one or more end-side balancing hollows.

In a sub-variant, outer balancing masses 6 (FIG. 1) are used in the area of the pilot gear system.

What is claimed is:

1. Twin screw system for a screw pump in axis-parallel arrangement, with counter-running outer axis engagement, and with angles of contact of at least 720° in single flight design, said arrangement being able to receive balancing hollows in the ends, wherein the screw lengths are not integer multiples of the pitch.

2. Twin screw system according to claim 1, wherein the screw length is greater by an integer multiple of the pitch than 1½ times the pitch.

3. Twin screw system according to claim 1, wherein the screw outer contours have in the medium inlet area a structure which creates final balancing of the system.

4. Twin screw system according to claim 1, wherein the screws do not feature any inner balancing hollow.

5. Twin screw system according to claim 1, wherein only one end of the screw is provided with an inner balancing hollow.

6. Twin screw system according to claim 1, wherein both screw ends are provided with a balancing hollow.

7. Twin screw system according to claim 5, wherein the winding angles of the balancing hollows can be varied for optimum adaptation.

8. Twin screw system according to claim 6, wherein the winding angles of the balancing hollows can be varied for optimum adaptation.

9. Twin screw system according to claim 2, wherein the screws do not feature any inner balancing hollow.

10. Twin screw system according to claim 2, wherein only one end of the screw is provided with an inner balancing hollow.

11. Twin screw system according to claim 2, wherein both screw ends are provided with a balancing hollow.

12. Twin screw system according to claim 10, wherein the winding angles of the balancing hollows can be varied for optimum adaptation.

13. Twin screw system according to claim 11, wherein the winding angles of the balancing hollows can be varied for optimum adaptation.

14. Twin screw system according to claim 3, wherein the screws do not feature any inner balancing hollow.

15. Twin screw system according to claim 3, wherein only one end of the screw is provided with an inner balancing hollow.

16. Twin screw system according to claim 15, wherein the winding angle of the balancing hollow can be varied for optimum adaptation.

17. Twin screw system according to claim 2, wherein the screw outer contours have in the medium inlet area a structure which creates final balancing of the system.

18. Twin screw system according to claim 17, wherein the screws do not feature any inner balancing hollow.

19. Twin screw system according to claim 17, wherein only one end of the screw is provided with an inner balancing hollow.

20. Twin screw system according to claim 19, wherein the winding angle of the balancing hollow can be varied for optimum adaptation.

* * * * *

UNITED STATES PATENT AND TRADEMARK OFFICE

CERTIFICATE OF CORRECTION

PATENT NO. : 6,139,297
DATED : October 31, 2000
INVENTOR(S) : Ulrich Becher

It is certified that error appears in the above-identified patent and that said Letters Patent is hereby corrected as shown below:

Column 1,
Line 23, please delete "band" and insert in lieu thereof -- hand --.

Column 2,
Line 1, please delete "pitch 1" and insert in lieu thereof -- pitch 1-- (letter L).
Line 14, please delete "1" and insert in lieu thereof -- 1 -- (letter L).
Line 18, please delete "2π/1" and insert in lieu thereof -- 2π/1 -- (letter L).
Line 38, please delete "a1" and insert in lieu thereof -- $a_1$ --.
Line 51-52, please delete 5.½, 7.½, 9.½ and insert in lieu thereof -- 5.1/2, 7·1/2, 9·1/2 -- (letter L).

Signed and Sealed this

Twenty-third Day of October, 2001

*Attest:*

Nicholas P. Godici

NICHOLAS P. GODICI
*Acting Director of the United States Patent and Trademark Office*

*Attesting Officer*